US006885152B2

(12) United States Patent
Johnson et al.

(10) Patent No.: US 6,885,152 B2
(45) Date of Patent: Apr. 26, 2005

(54) MULTILAYER FIELD EMISSION KLYSTRON

(75) Inventors: Scott V. Johnson, Scottsdale, AZ (US); Bernard F. Coll, Fountain Hills, AZ (US); Kenneth A. Dean, Phoenix, AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/402,119

(22) Filed: Mar. 28, 2003

(65) Prior Publication Data

US 2004/0189210 A1 Sep. 30, 2004

(51) Int. Cl.[7] ..... H01J 23/08
(52) U.S. Cl. ..... 315/5.35; 313/447
(58) Field of Search ..... 315/5.35, 5.37, 315/5.38; 313/444, 446, 447, 448

(56) References Cited

U.S. PATENT DOCUMENTS 5,124,664 A * 6/1992 Cade et al. ..... 330/45
5,203,731 A * 4/1993 Zimmerman ..... 445/24
5,534,743 A * 7/1996 Jones et al. ..... 313/309
5,534,747 A * 7/1996 Carruthers ..... 313/456
5,637,954 A * 6/1997 Van Gorkom et al. ..... 313/422
5,796,211 A * 8/1998 Graebner et al. ..... 315/3.5
5,821,693 A * 10/1998 White et al. ..... 315/5.39

* cited by examiner

*Primary Examiner*—Thuy Vinh Tran

(57) ABSTRACT

An exemplary system and method for providing a multilayer klystron-type electron beam device for the generation and amplification of millimeter-wave electromagnetic radiation is disclosed as comprising inter alia: a cathode layer (130); a collector layer (100); an extraction layer (120); a control layer (140); an input cavity (150); an output cavity (170); several ceramic spacer layers (103, 105, 107) dispose intermediately between the cathode (130) and the collector (100); and optionally, several magnetic ceramic layers (160, 165) for beam forming and focusing. After the klystron's layers are assembled, the device may be fired to form a substantially monolithic structure.

18 Claims, 1 Drawing Sheet

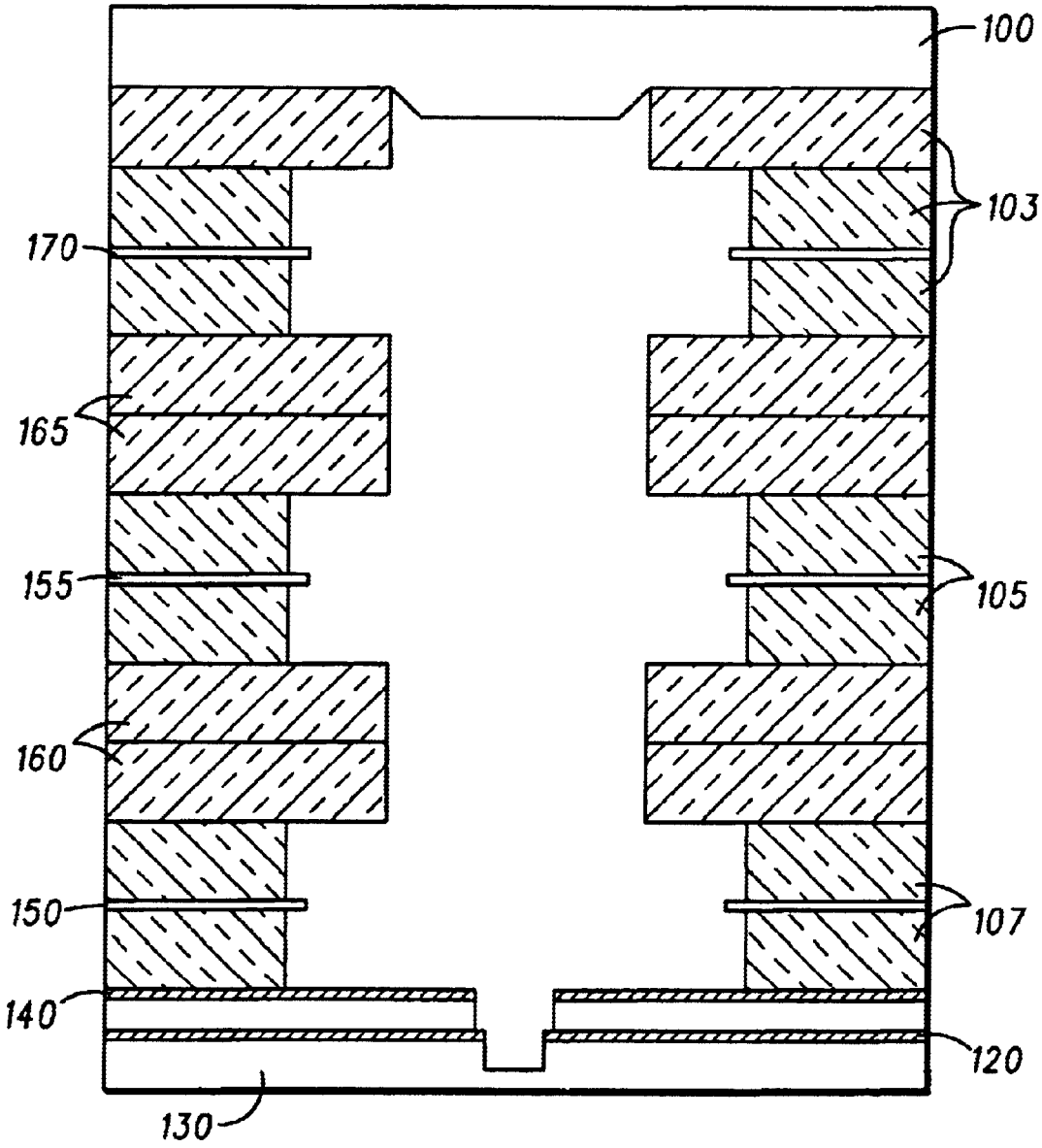
100
103
170
165
155
105
160
150
107
140
120
130

MULTILAYER FIELD EMISSION KLYSTRON

FIELD OF INVENTION

The present invention generally concerns field emission electron beam devices; and more particularly, in various representative and exemplary embodiments, to low-power multilayer klystrons suitably adapted to provide high efficiency and wide bandwidth.

BACKGROUND

Linear beam electron devices are used in sophisticated communication and RADAR systems that generally require amplification of radio frequency (RF) or microwave electromagnetic radiation. A conventional klystron is an example of a linear beam electron device that has been used as a microwave amplifier. In a conventional klystron device, an electron beam originating from an electron gun may be caused to propagate through a drift tube that passes across a number of gaps, each gap corresponding to part of a resonant cavity of the klystron. The velocity of the electron beam is typically modulated by an RF input signal introduced at the first resonant cavity. The velocity modulation of the beam generally results in electron bunching due to electrons that have had their velocities increased gradually passing electrons that have had their velocities decreased. The traveling bunches of electrons generally correspond to an RF current in the beam, which induces electromagnetic energy in subsequent resonant cavities. The electromagnetic energy may thereafter be extracted from the last resonant cavities as amplified RF output.

Bandwidth and efficiency are both of some importance in klystrons. For example, the information rate of a signal a given klystron can amplify generally increases with the bandwidth. Also, the power consumed by the klystron typically decreases with increasing efficiency. The bandwidth of a klystron generally increases as the ratio of beam current to beam voltage increases, or rather, as the beam conductance is increased. This generally occurs when the load conductance across the output cavity and the loading conductances that the beam produces in the intermediate cavities are proportional to the beam conductance. Therefore, the quality factor (Q) for these cavities, which is a measure of the energy stored to the energy lost per cycle, generally decreases as the beam conductance is increased. Accordingly, bandwidth is also inversely proportional to Q.

The beam conductance may be determined by the perveance of the electron gun which produces the electrons and by the voltage at which the electron gun is operated. The perveance (K) is defined by the relationship between the beam current (I) and the beam voltage (V) as $I=K\sqrt{V^3}$. The perveance is generally 1E-6 to 3E-6 amperes per $(\text{Volt}^3)^{1/2}$ for the average klystron. The beam conductance $$\left(\frac{1}{V}\right)$$

may thus be expressed as $$\frac{1}{V} = K\sqrt{V}.$$

In low-power klystrons, the beam voltage is usually comparatively low with the corresponding power output typically less than 1 kilowatt. One approach for increasing the bandwidth has been to increase the perveance since increasing the perveance generally increases the beam conductance and thus the bandwidth. However, this approach has had at least two disadvantages. First, if the perveance is made high, there is an adverse impact on the efficiency of the device because the space-charge forces in the beam generally increase making it difficult to tightly bunch the electrons of the beam. Second, as the perveance is increased at constant electron beam power, the beam voltage must generally be decreased. This typically results in a decrease in the electron beam velocity since the electron beam velocity is proportional to the square root of beam voltage. Furthermore, the dimensions of the cavity gaps along the beam must generally be held constant in terms of electron transit time in order to maintain good coupling of the cavity gap fields to the electrons. Therefore, the dimensions of these cavity gaps may be required to become extremely small in high frequency applications. Notably, there are substantial deficiencies associated with the prior art's ability to provide methods for the manufacture of klystrons suitably adapted for high-frequency operation. For example, U.S. Pat. No. 5,534,747 (Caruthers); U.S. Pat. No. 6,400,069 (Espinosa); U.S. Pat. No. 6,326,730 (Symons) and U.S. Pat. No. 5,796,211 (Graebner, et al.) generally describe conventional features of klystron design and construction, but do not address the problems of miniaturization and fabrication costs for the enablement of high frequency operation. Consequently, conventional klystrons have not generally found use at frequencies above 26 GHz due to limitations inherent to existing vacuum device processing.

Accordingly, it would be desirable to provide an efficient klystron for low-power, wide-bandwidth applications that could be easily fabricated. Furthermore, it would be desirable to provide a design methodology that would allow construction of various low-power klystrons for specific applications having relatively low output power and high efficiency, but at much higher frequencies and utilizing larger, more easily fabricated parts than may be found in klystrons of conventional design.

SUMMARY OF THE INVENTION

In various representative aspects, the present invention provides a system and method for providing a multilayer field emission klystron suitably adapted for high frequency operation. An exemplary system and method for providing such a device is disclosed as comprising inter alia: a field emission cathode layer, a collector layer; an extraction layer; a control layer, an input cavity; an output cavity; several ceramic spacer layers dispose intermediately between the cathode and the collector; and optionally, several magnetic ceramic layers for beam forming and focusing. After the klystron's ceramic layers are assembled, the multilayer device may be fired to form a substantially monolithic structure capable of economical generation of millimeter wave RF energy in accordance with various aspects of the present invention. Fabrication is relatively simple and straightforward. Power and frequency of operation may be easily altered without fundamental design changes. Additional advantages of the present invention will be set forth in the Detailed Description which follows and may be obvious from the Detailed Description or may be learned by practice of exemplary embodiments of the invention. Still other advantages of the invention may be realized by means of any of the instrumentalities, methods or combinations particularly pointed out in the Claims.

BRIEF DESCRIPTION OF THE DRAWING

Representative elements, operational features, applications and/or advantages of the present invention reside inter alia in the details of construction and operation as more fully hereafter depicted, described and claimed—reference being made to the accompanying drawing forming a part hereof, wherein like numerals refer to like parts throughout. Other elements, operational features, applications and/or advantages will become apparent to skilled artisans in light of certain exemplary embodiments recited in the Detailed Description, wherein:

The FIGURE representatively depicts a cross-sectional view of a ceramic multilayer field emission klystron device in accordance with an exemplary embodiment of the present invention.

Those skilled in the art will appreciate that elements in the FIGURE are illustrated for simplicity and clarity and have not necessarily been drawn to scale. For example, the dimensions of some of the elements in the FIGURE may be exaggerated relative to other elements to help improve understanding of various embodiments of the present invention. Furthermore, the terms 'first', 'second', and the like herein, if any, are used inter alia for distinguishing between similar elements and not necessarily for describing a sequential or chronological order. Moreover, the terms front, back, top, bottom, over, under, and the like in the Description and/or in the Claims, if any, are generally employed for descriptive purposes and not necessarily for comprehensively describing exclusive relative position. Skilled artisans will therefore understand that any of the preceding terms so used may be interchanged under appropriate circumstances such that various embodiments of the invention described herein, for example, are capable of operation in other orientations than those explicitly illustrated or otherwise described.

DETAILED DESCRIPTION OF EXEMPLARY EMBODIMENTS

The following descriptions are of exemplary embodiments of the invention and the inventors' conceptions of the best mode and are not intended to limit the scope, applicability or configuration of the invention in any way. Rather, the following Description is intended to provide convenient illustrations for implementing various embodiments of the invention. As will become apparent, changes may be made in the function and/or arrangement of any of the elements described in the disclosed exemplary embodiments without departing from the spirit and scope of the invention.

A detailed description of an exemplary application, namely a system and method for field emission klystron operation at millimeter wave frequencies is provided as a specific enabling disclosure that may be readily generalized by skilled artisans to any application of the disclosed system and method for electron beam applications in accordance with various embodiments of the present invention.

The FIGURE representatively depicts multilayer field emission klystron device in accordance with an exemplary embodiment of the present invention. The device is generally disclosed as comprising inter alia: a thin film planar constructed field emission cathode comprising a carbon nanotube array or other field emissive devices (e.g., Spindt tips 130, etc.) in conjunction with thick film ceramic multilayer spacers 103, 105, 107 to yield a multiple resonator cavity structure; a collector layer 100; an extraction grid layer 120; a control grid layer 140; an input cavity 150; and an output cavity 170. Optional cavity 155 would only be used in certain applications, such as an oscillator. Optionally, ceramic magnetic layers 160, 165 may be incorporated into the stack for beam forming and focusing. Since firing the multilayer assembly would generally take the magnetic layers 160, 165 past their Curie point, poleing may be accomplished after firing. The ability to build-up laminar layers lends itself very well to producing millimeter wave devices capable of generating from a few milliwatts to several watts of RF power.

The combination of extremely small size, low cost manufacturing and high performance set the device apart from conventional klystrons at one end of the spectrum (which are generally bulky, costly and typically unable to operate at millimeter wave frequencies) to solid state sources such as IMPATT diodes (which are able to operate at millimeter wave frequencies, but at very low power and which are generally incapable of linear amplification). The multi-layer, thick film klystron in accordance with the present invention may suitably adapted to operate as an oscillator or an amplifier, and by adding successive cavities, may also be adapted to provide substantial gain. Representative applications of such devices may include anti-collision RADAR systems operating at about 77 GHz for low cost automotive applications, as well as communications, intrusion detection and aeronautical applications such as, for example, missile seekers, electronic counter measures (ECM), RADAR, etc.

Devices in accordance with various exemplary embodiments of the present invention may be fabricated using any well-known Low Temperature Co-fired Ceramic (LTCC) technology used in, for example, the production of microelectronic structures such as, but not limited to, filters, resonators, and hybrid circuits. LTCC manufacturing would also provide devices capable of demonstrating several other beneficial features, including, for example: low-loss, high RF performance (i.e., high electrical Q), low impedance metallization, uniform and stable mechanical properties, relatively low fabrication cost, high production volume, etc.

In the foregoing specification, the invention has been described with reference to specific exemplary embodiments; however, it will be appreciated that various modifications and changes may be made without departing from the scope of the present invention as set forth in the claims below. The specification and figures are to be regarded in an illustrative manner, rather than a restrictive one and all such modifications are intended to be included within the scope of the present invention. Accordingly, the scope of the invention should be determined by the claims appended hereto and their legal equivalents rather than by merely the examples described above. For example, the steps recited in any method or process claims may be executed in any order and are not limited to the specific order presented in the claims. Additionally, the components and/or elements recited in any apparatus claims may be assembled or otherwise operationally configured in a variety of permutations to produce substantially the same result as the present invention and are accordingly not limited to the specific configuration recited in the claims.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components of any or all the claims.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted by those skilled in the art to specific environments, manufacturing specifications, design parameters or other operating requirements without departing from the general principles of the same.

We claim:

1. A multilayer field emission klystron, comprising:

a cathode layer, said cathode layer having a surface for emitting electrons;

a collector layer, said collector layer disposed away from said cathode layer, said collector layer for collecting electrons emitted from said cathode layer;

an extraction layer, said extraction layer disposed substantially between said cathode layer and said collector layer, said extraction layer for drawing electrons away from said cathode layer;

a control layer, said control layer disposed substantially between said extraction layer and said collector layer, said control layer for shaping an electron beam formed by said electrons drawn away from said cathode layer toward said collector layer;

an input cavity, said input cavity disposed substantially between said control layer and said collector layer, said input cavity for modulating a velocity of said electron beam;

an output cavity, said output cavity disposed substantially between said input cavity and said collector layer, said output cavity for extracting energy from said electron beam; and spacer material, said spacer material forming at least a plurality of spacing layers intermediately disposed between said cathode layer and said collector layer.

2. The multilayer field emission klystron of claim 1, further comprising a beam magnet stack layer; said beam magnet stack disposed substantially between said input cavity and said output cavity, said beam magnet stack configured for shaping said electron beam.

3. The multilayer field emission klystron of claim 2, wherein said beam magnet stack comprises a magnetic ceramic material.

4. The multilayer field emission klystron of claim 1, wherein said cathode layer comprises a thin-film field emission element.

5. The multilayer field emission klystron of claim 1, wherein said extraction layer comprises a substantially laminar grid.

6. The multilayer field emission klystron of claim 1, wherein said control layer comprises a substantially laminar grid.

7. The multilayer field emission klystron of claim 1, wherein said spacer material comprises a ceramic.

8. The multilayer field emission klystron of claim 1, wherein dimensions of said klystron are for millimeter wave applications utilizing up to about 10 watts of RF power.

9. The multilayer field emission klystron of claim 8, wherein frequency of said RF power is between about 26 GHz and 200 GHz.

10. A method for forming a field emission klystron, comprising the steps of:

providing a cathode layer having a surface for emitting electrons;

providing a collector layer, said collector layer disposed away from said cathode layer, said collector layer for collecting electrons emitted from said cathode layer;

providing an extraction layer, said extraction layer disposed substantially between said cathode layer and said collector layer, said extraction layer for drawing electrons away from said cathode layer;

providing a control layer, said control layer disposed substantially between said extraction layer and said collector layer, said control layer for shaping an electron beam formed by said electrons drawn away from said cathode layer toward said collector layer;

providing an input cavity, said input cavity disposed substantially between said control layer and said collector layer, said input cavity for modulating the velocity of said electron beam;

providing an output cavity, said output cavity disposed substantially between said input cavity and said collector layer, said output cavity for extracting energy from said electron beam; and providing spacer material intermediately disposed between said cathode layer and said collector layer.

11. The method for forming the field emission klystron of claim 10, further comprising the step of providing a beam magnet stack layer; said beam magnet stack disposed substantially between said input cavity and said output cavity, said beam magnet stack for shaping said electron beam.

12. The method for forming the field emission klystron of claim 11, wherein said beam magnet stack comprises a magnetic ceramic material and said magnetic material is poled substantially after firing of said ceramic material.

13. The method for forming the field emission klystron of claim 10, wherein said cathode layer comprises a thin-film field emission element deposited on a ceramic substrate.

14. The method for forming the field emission klystron of claim 10, wherein said extraction layer comprises a substantially laminar grid deposited on a ceramic substrate.

15. The method for forming the field emission klystron of claim 10, wherein said control layer comprises a substantially laminar grid deposited on a ceramic substrate.

16. The method for forming the field emission klystron of claim 10, wherein said spacer material comprises ceramic which, after the klystron layers are assembled, is fired to produce a substantially monolithic device package.

17. The method for forming the field emission klystron of claim 10, wherein dimensions of said klystron are for millimeter wave applications utilizing up to about 10 watts of RF power.

18. The method for forming the field emission klystron of claim 10, wherein frequency of said RF power is between about 26 GHz and 200 GHz.

* * * * *